US010011937B2

(12) United States Patent
Borlin et al.

(10) Patent No.: US 10,011,937 B2
(45) Date of Patent: Jul. 3, 2018

(54) LAUNDRY TREATING APPLIANCE AND METHOD OF ASSEMBLY

(71) Applicant: WHIRLPOOL CORPORATION, Benton Harbor, MI (US)

(72) Inventors: Christopher L. Borlin, Stevensville, MI (US); Gregory M. Garstecki, Saint Joseph, MI (US); George W. Malheiros, Saint Joseph, MI (US); Christopher H. Matulis, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 162 days.

(21) Appl. No.: 14/948,887

(22) Filed: Nov. 23, 2015

(65) Prior Publication Data

US 2017/0145618 A1 May 25, 2017

(51) Int. Cl.

*D06F 37/22* (2006.01)
*D06F 37/30* (2006.01)
*D06F 37/26* (2006.01)

(52) U.S. Cl.

CPC ..... *D06F 37/22* (2013.01); *D06F 37/265* (2013.01); *D06F 37/268* (2013.01); *D06F 2222/00* (2013.01)

(58) Field of Classification Search

CPC ..... D06F 37/22; D06F 37/265; D06F 37/268; D06F 2222/00

See application file for complete search history.

(56) References Cited

U.S. PATENT DOCUMENTS 2,642,996 A 6/1953 Oeler et al.
5,267,456 A * 12/1993 Nukaga ..... D06F 37/302 188/69
5,570,597 A * 11/1996 Bongini ..... D06F 37/22 68/139
5,961,105 A * 10/1999 Ehrnsberger ..... D06F 37/20 188/129
6,622,530 B1 9/2003 Sumer et al.
7,533,548 B2 5/2009 Chang
7,536,882 B2 5/2009 Kim et al.
2002/0020196 A1* 2/2002 Kakuda ..... D06F 23/06 68/12.06
2003/0029206 A1* 2/2003 Cho ..... D06F 37/265 68/23.2
2005/0217323 A1 10/2005 Lee et al.
2006/0174666 A1* 8/2006 Je ..... D06F 37/265 68/235 R
2008/0282746 A1* 11/2008 Komori ..... D06F 23/06 68/23.2
2009/0071199 A1 3/2009 Kwon et al.
2011/0023554 A1 2/2011 Clark et al.
(Continued)

*Primary Examiner* — Joseph L. Perrin

(57) ABSTRACT

A laundry treating appliance for treating laundry according to an automatic cycle of operation includes a chassis defining an interior, a tub provided within the interior, a drum provided within the tub, a motor mounted to the tub and having a drive shaft drivingly coupled to the drum to selectively rotate the drum about the longitudinal axis, a suspension system, and at least one counterweight, wherein the suspension system and the at least one counterweight are configured such that the capacity efficiency of the laundry treating appliance is greater than 45%.

24 Claims, 6 Drawing Sheets

(56) References Cited

U.S. PATENT DOCUMENTS

| | | | | |
|---|---|---|---|---|
| 2012/0006070 | A1* | 1/2012 | Song | D06F 37/04 68/140 |
| 2012/0042699 | A1* | 2/2012 | Kwon | D06F 37/22 68/140 |
| 2012/0090362 | A1* | 4/2012 | Hwang | D06F 37/22 68/139 |

* cited by examiner

LAUNDRY TREATING APPLIANCE AND METHOD OF ASSEMBLY

BACKGROUND

Laundry treating appliances, such as clothes washers, refreshers, and non-aqueous systems, may have a configuration based on a cabinet within which is housed the components of the appliance, including a tub. The tub may house a rotating drum that defines a treating chamber in which laundry items are placed for treating. The dimensions of the tub are defined in part by the space available within the cabinet, which, in turn, define the dimensions of the drum which receive the laundry items for treatment.

BRIEF SUMMARY

According to an embodiment of the invention, a laundry treating appliance for treating laundry according to an automatic cycle of operation comprises a chassis defining an interior, a tub provided within the interior, a drum provided within the tub, a suspension system, and at least one counterweight, wherein the suspension system and the at least one counterweight are configured such that the capacity efficiency of the laundry treating appliance is greater than 45%.

DETAILED DESCRIPTION

Figure 1:
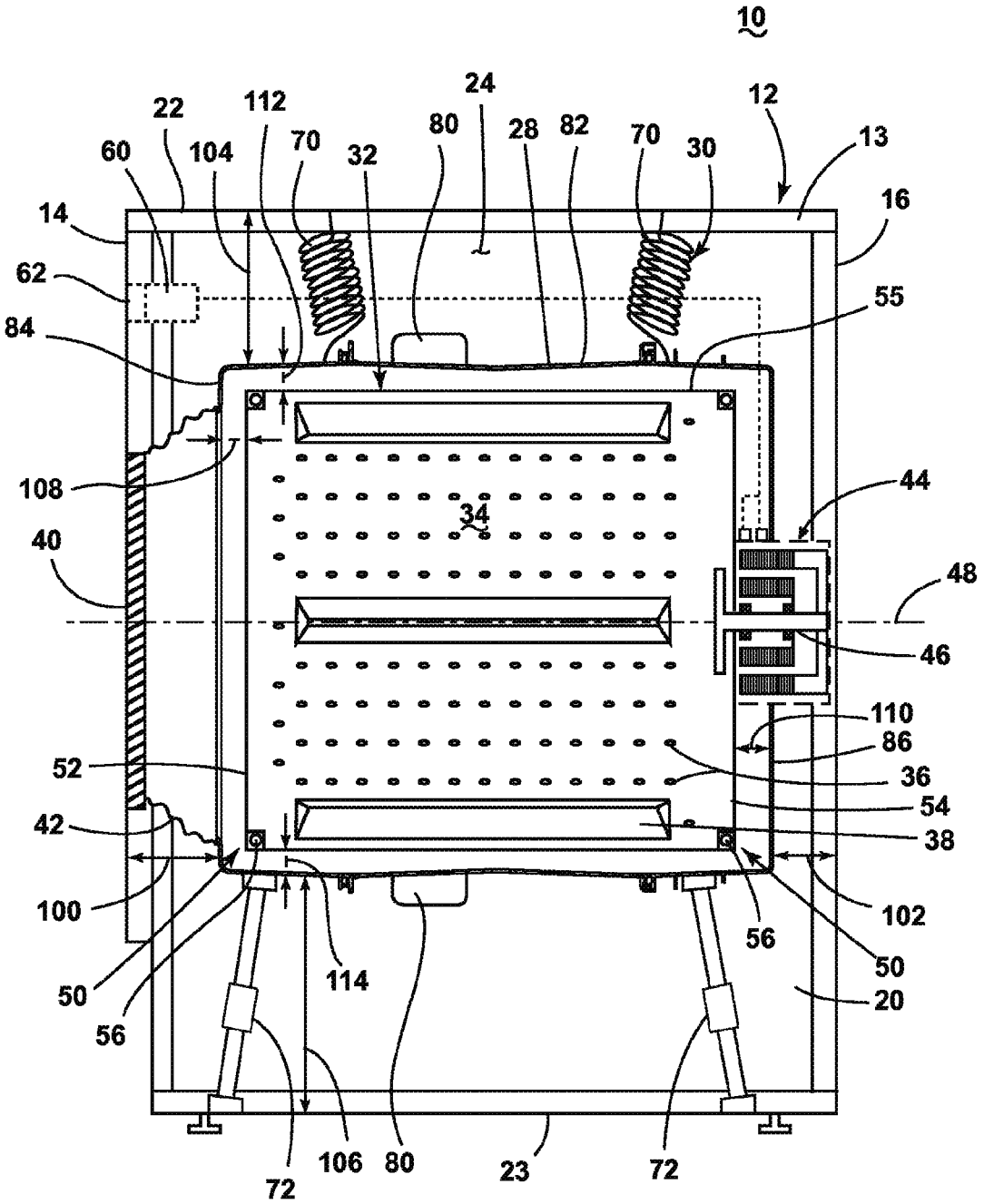
FIG. 1 is a schematic cross-sectional view of a laundry treating appliance in the form of a washing machine according to a first embodiment of the invention.

FIG. 1 is a schematic view of a laundry treating appliance according to an embodiment of the invention. The laundry treating appliance may be any appliance which performs a cycle of operation to clean or otherwise treat items placed therein, non-limiting examples of which include a horizontal axis clothes washer; a clothes dryer; a combination washing machine and dryer; a tumbling or stationary refreshing/revitalizing machine; an extractor; a non-aqueous washing apparatus; and a revitalizing machine. As used herein, the term "horizontal axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

Figure 2:
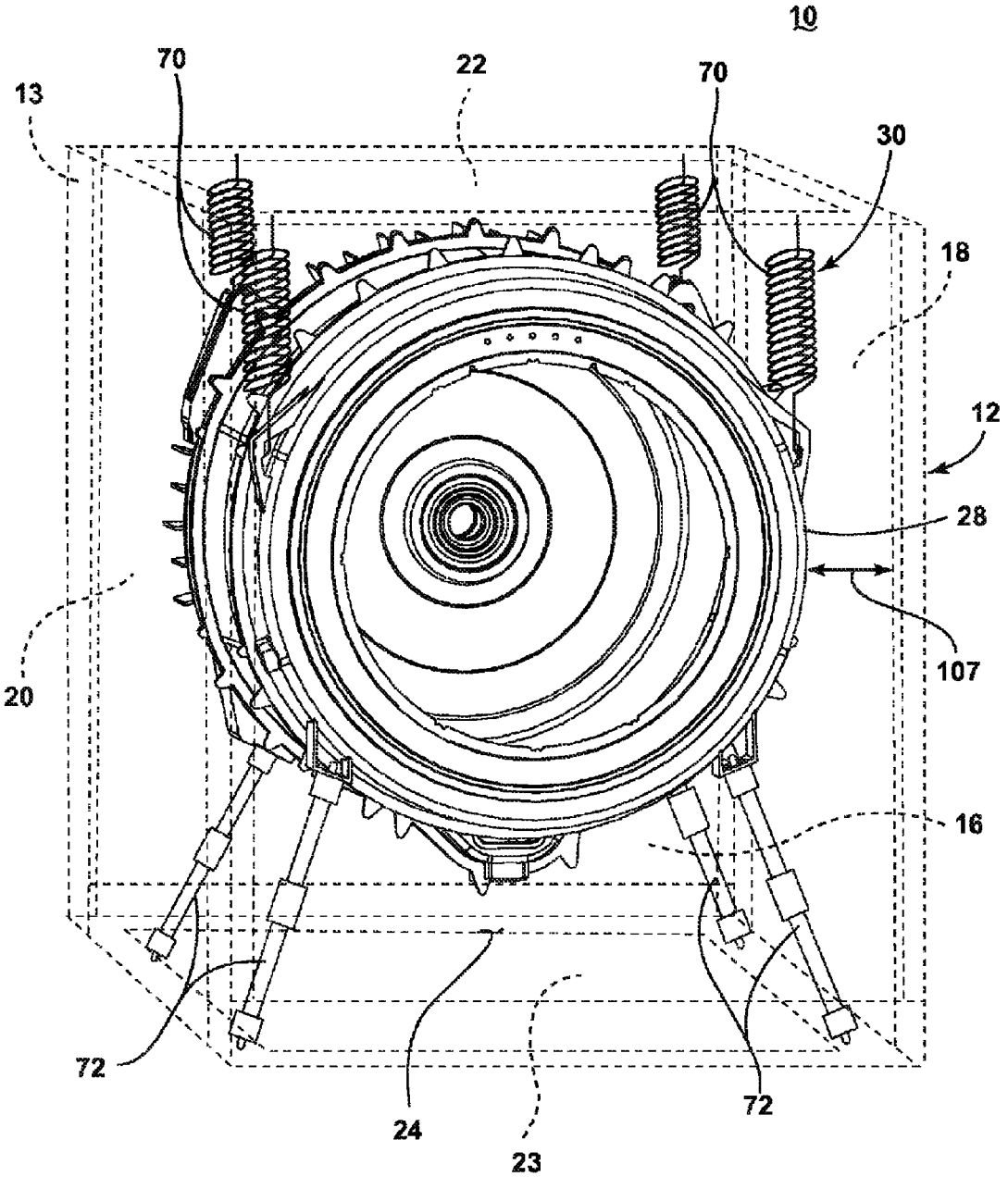
FIG. 2 is a perspective view of the laundry treating appliance of FIG. 1 with a front wall of a chassis of the laundry treating appliance removed and the remaining walls of the chassis illustrated as transparent according to an embodiment of the invention.

As may best be seen in FIGS. 1 and 2, the laundry treating appliance is illustrated as a washing machine 10, which may include a structural support system comprising a chassis 12 which provides a frame 13 which may be used to support additional components of the washing machine 10. The chassis 12 may further include a front wall or panel 14, a rear wall 16, opposing side walls 18 and 20, an upper wall 22, and a bottom wall 23, that can be coupled or integrally formed with the frame 13 of the chassis 12. The frame 13 and the walls 14, 16, 18, 20, 22, and 23 together enclose the internal components of the washing machine 10 and can also be referred to as a cabinet. The walls 14, 16, 18, 20, 22, and 23 may be coupled with the frame of the chassis 12 using any suitable mechanical or non-mechanical fastener or combination of fasteners, non-limiting examples of which include bolts, screws, snap-fit fasteners, clips, clamps, adhesives, or welds. If the washing machine 10 is a built-in appliance such that one or more sides of the washing machine 10 are encompassed by cabinetry, walls, paneling or furniture at the installation site, one or more of the walls 14, 16, 18, 20, 22, and 23 may not be included. The chassis 12, and optionally the walls 14, 16, 18, 20, 22, and 23 may define an interior 24 enclosing components typically found in a conventional washing machine, such as motors, pumps, fluid lines, controls, sensors, transducers, and the like. Such components will not be described further herein except as necessary for a complete understanding of the invention.

A laundry holding system is supported by the chassis 12 through a suspension system 30 and is defined by a tub 28, a drum 32 provided within the tub 28, and a laundry treating chamber 34 at least partially defined by the drum 32. The drum 32 may include a plurality of perforations 36 such that liquid may flow between the tub 28 and the drum 32 through the perforations 36. A plurality of baffles 38 may be disposed on an inner surface of the drum 32 to lift the laundry load received in the treating chamber 34 while the drum 32 rotates.

The laundry holding system may further include a door 40 which may be movably mounted to the chassis 12 to selectively close both the tub 28 and the drum 32. A bellows 42 may couple an open face of the tub 28 with the chassis 12, with the door 40 sealing against the bellows 42 when the door 40 closes the tub 28.

The washing machine 10 also includes a drive system for rotating the drum 32 within the tub 28. The drive system may include a motor 44, which may be mounted to the tub 28 and directly coupled with the drum 32 through a drive shaft 46 to rotate the drum 32 about a longitudinal axis 48 of the tub 28 and drum 32 during a cycle of operation. The motor 44 may be a brushless permanent magnet (BPM) motor having a stator and a rotor. Alternately, the motor 44 may be coupled to the drum 32 through a belt and a drive shaft to rotate the drum 32, as is known in the art. Other motors, such as an induction motor or a permanent split capacitor (PSC) motor, may also be used. The motor 44 may rotate the drum 32 at various speeds in either rotational direction.

The washing machine 10 may include additional features typically found in a conventional washing machine, the details of which are not germane to the present invention.

For example, the washing machine 10 may include a liquid supply system for supplying water to the washing machine 10 for use in treating laundry during a cycle of operation and a dispensing system for dispensing treating chemistry to the treating chamber 34 for use in treating the laundry according to a cycle of operation. The washing machine 10 may also include a recirculation and drain system for recirculating liquid within the laundry holding system and draining liquid from the washing machine 10. Liquid is typically supplied to the tub 28, but it may also be provided directly to the drum, enter a space between the tub 28 and the drum 32 and may flow by gravity to a drain conduit, which may drain the liquid from the washing machine 10, or to a recirculation conduit to direct liquid into the drum 32. In this manner, liquid provided to the tub 28, with or without treating chemistry may be recirculated into the treating chamber 34 for treating the laundry within. The liquid supply and/or recirculation and drain system may be provided with a heating system which may include one or more devices for heating laundry and/or liquid supplied to the tub 28, such as a steam generator and/or a sump heater, the details of which are not germane to the present invention. Any suitable liquid supply system, dispensing system, recirculation system and/or drain system may be used with the embodiments of the present invention, the details of which are not germane to the present invention.

The washing machine 10 may also include at least one dynamic balancer 50 at or near a front drum wall 52 and/or rear drum wall 54 of the drum 32 which includes a moveable mass 56 to offset an imbalance that may occur in the treating chamber 34 during rotation of the drum 32 during a cycle of operation. The dynamic balancers 50 may be secured to the front drum wall 52 and/or the rear drum wall 54, as illustrated, or to a drum side wall 55 adjacent the front drum wall 52 and/or the rear drum wall 54.

The washing machine 10 also includes a control system for controlling the operation of the washing machine 10 to implement one or more cycles of operation. The control system may include a controller 60 located within the chassis 12 and a user interface 62 that is operably coupled with the controller 60. The user interface 62 may include one or more knobs, dials, switches, displays, touch screens and the like for communicating with the user, such as to receive input and provide output. The user may enter different types of information including, without limitation, cycle selection and cycle parameters, such as cycle options.

The controller 60 may include the machine controller and any additional controllers provided for controlling any of the components of the washing machine 10. For example, the controller 60 may include the machine controller and a motor controller. Many known types of controllers may be used for the controller 60. The specific type of controller is not germane to the invention. It is contemplated that the controller 60 is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components. The controller 60 may be provided with a memory for storing control software that is executed by a central processing unit of the controller 60 in completing a cycle of operation using the washing machine 10 and any additional software.

The controller 60 may be operably coupled with one or more components of the washing machine 10 for communicating with and controlling the operation of the component to complete a cycle of operation. For example, the controller 60 may be operably coupled with the motor 44 and any other additional components that may be present such as a steam generator, a treating chemistry dispenser, and a sump heater (not shown) to control the operation of these and other components to implement one or more of the cycles of operation. The controller 60 may also be coupled with one or more sensors provided in one or more of the systems of the washing machine 10 to receive input from the sensors, which are known in the art and not shown for simplicity. Non-limiting examples of sensors that may be communicably coupled with the controller 60 include: a treating chamber temperature sensor, a moisture sensor, a weight sensor, a chemical sensor, an optical sensor, a conductivity sensor, a turbidity sensor, a position sensor and a motor torque sensor, which may be used to determine a variety of system, laundry and liquid characteristics, such as laundry load inertia or mass.

The suspension system 30 dynamically suspends the laundry holding system within the structural support system and includes at least three springs 70 coupling an upper portion of the tub 28 to the chassis 12 and at least three dampers 72 supporting a lower portion of the tub 28 within the chassis 12. The dampers 72 are configured to provide friction force that is used to reduce the movement and vibration of the laundry holding system. The washing machine 10 may also include at least one counterweight 80 provided on the tub 28. The counterweight 80 may be coupled with a tub side wall 82 along the longitudinal axis 48 between a front tub wall 84 and a rear tub wall 86.

Figure 3:
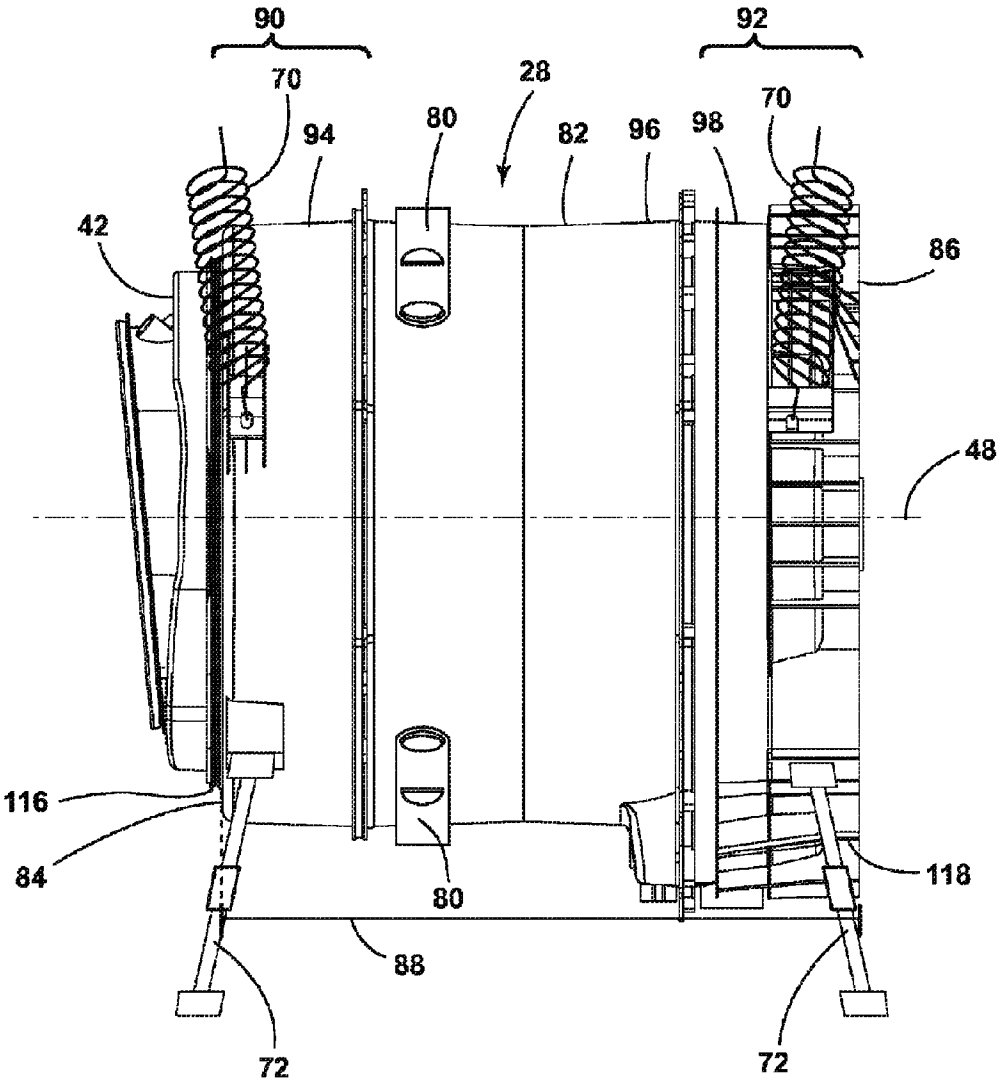
FIG. 3 is a side view of a tub and suspension system of the laundry treating appliance of FIG. 1 according to an embodiment of the invention.

Referring now to FIG. 3, the tub 28 has a longitudinal length 88 extending from the open face of the tub 28 to the rear tub wall 86 and includes a front portion 90 near the open face of the tub 28 and a rear portion 92 near the rear tub wall 86. The suspension system 30 includes at least one spring 70 coupled with the front portion 90 and at least one spring 70 coupled with the rear portion 92. As illustrated in the embodiment of FIG. 3, at least one spring 70 is coupled with an upper portion of the tub 28 within the front and rear portion 90, 92 of the tub. The upper and lower portions of the tub 28 may be considered the portions of the tub side wall 82, front tub wall 84 and rear tub wall 86 located above and below the longitudinal axis 48 of the laundry holding system, respectively. The suspension system 30 also includes at least one damper 72 coupled with the lower portion of the tub 28 within the front portion 90 and at least one damper 72 coupled with the lower portion of the tub 28 within the rear portion 92. The suspension system 30 includes at least one additional spring 70 and one additional damper 72 at the front or rear portion 90 or 92. In an exemplary embodiment, the front and rear tub portions 90, 92 to which the suspension system 30 couples with the tub 28 may correspond to the front and rear thirds of the longitudinal length 88 of the tub 28.

The tub 28 may be any suitable tub made from any polymeric or metal-based material. In an exemplary embodiment, the tub 28 may be in the form of a multi-piece tub assembly having a front tub section 94, a middle tub section 96 and a rear tub section 98. As illustrated in FIG. 3, the front and rear tub portions 90, 92 to which the suspension system 30 couples with the tub 28 may correspond to the front tub section 94 and the rear tub section 98, respectively. Each of the tub sections 94, 96, 98 may be molded from a polymeric material or cast from a metal-based material and may be made from the same or a different material. It is also within the scope of the invention for the tub 28 to be made from a single molded or cast piece, two molded or cast pieces, or any desired number of molded or cast pieces or combinations thereof. An example of a suitable multi-piece tub assembly is described in co-pending application Ser. No. 14/288,788, filed May 28, 2014, entitled "Laundry Treating Appliance and Tub Assembly and Method of Forming" which is herein incorporated by reference in its entirety. Alternatively, the tub 28 may be in the form of a multi-piece tub which includes upper and lower sections.

Figure 4A:
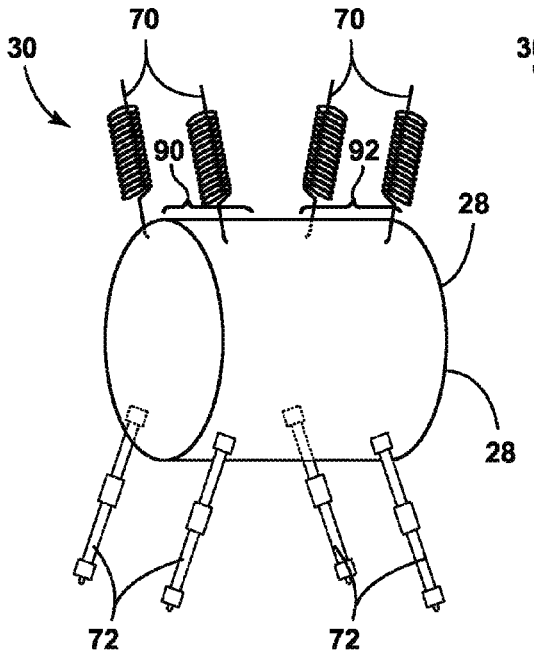
FIGS. 4A-4D are a schematic illustration of a suspension system for supporting a laundry holding system of a laundry treating appliance according to an embodiment of the invention.
Figure 4B:
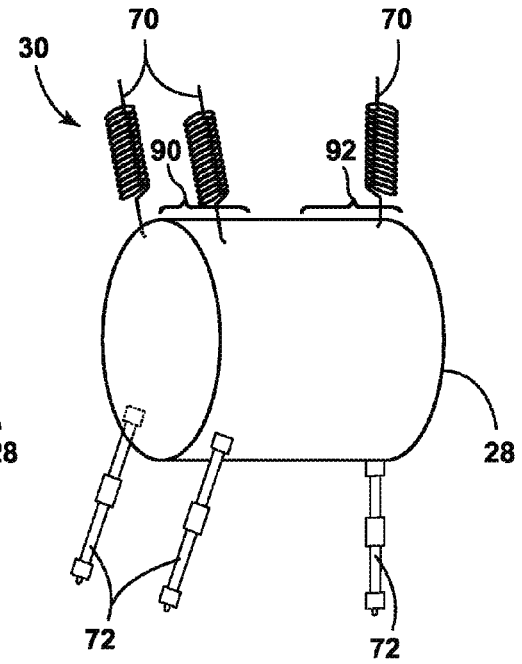
Figure 4C:
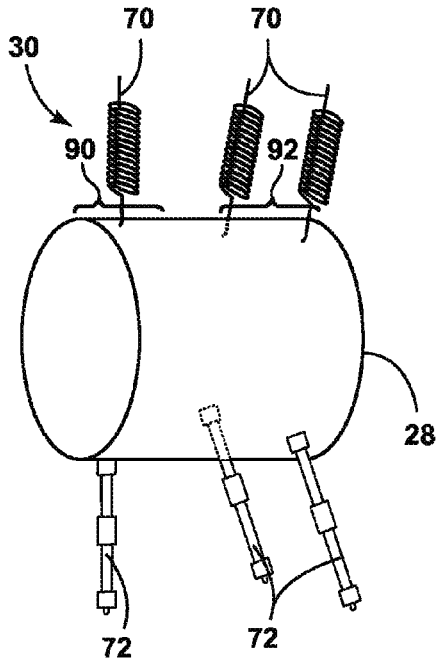
Figure 4D:
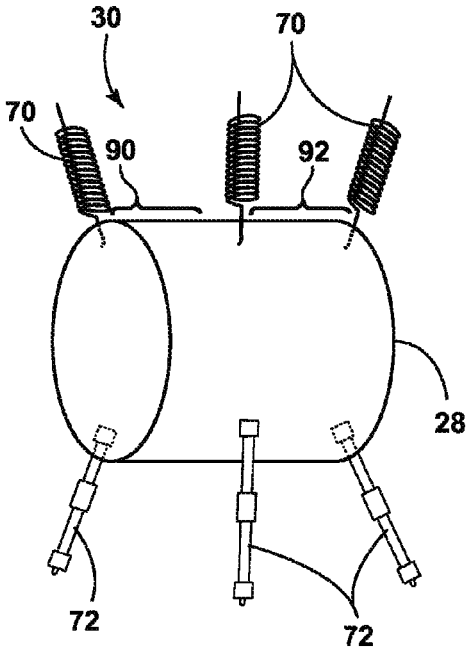

As illustrated in FIG. 4A, the suspension system 30 may include two pairs of springs 70 and two pairs of dampers 72. A first pair of springs 70 and a first pair of dampers 72 may be coupled with the upper and lower portions of the tub 28, respectively, within the front portion 90 and a second pair of springs 70 and a second pair of dampers 72 may be coupled with the upper and lower portions of the tub 28, respectively, within the rear portion 92. Alternatively, as illustrated in FIG. 4B, the suspension system 30 may include a pair of springs 70 and a pair of dampers 72 coupled with the upper and lower portions of the tub 28, respectively, within the front portion 90 and a single spring 70 and a single damper 72 coupled with the tub 28 within the rear portion 92. In another alternative, as illustrated in FIG. 4C, the suspension system 30 may include a single spring 70 and a single damper 72 coupled with the tub 28 within the front portion 90 and a pair of springs 70 and a pair of dampers 72 coupled with the upper and lower portions of the tub 28, respectively, within the rear portion 92. In yet another alternative, as illustrated in FIG. 4D, the suspension system 30 may include two springs 70 on one side of the tub 28, one within the front portion 90 and another within the rear portion 92, and a single spring 70 near the center of the tub 28 on the side opposite the first two springs 70. The dampers 72 can be similarly positioned with two dampers 72 on one side of the tub 28 within the front and rear portion 90, 92, and a third damper 72 provided near the center of the tub 28 on the side of the tub 28 opposite the first two dampers 72. As illustrated in FIG. 4D, the pairs of springs 70 and dampers 72 in the front and rear portion 90, 92 can be on the same side of the tub 28. The suspension system 30 may also include any number of additional springs 70 and/or dampers 72. In addition, while the suspension system 30 is illustrated as having an even number of springs 70 to dampers 72 such that each spring 70 corresponds to a damper 72, it is also within the scope of the invention for there to be an uneven number of springs 70 to dampers 72. For example, the washing machine 10 may include 3 springs 70 and 4 dampers 72 or vice versa.

The washing machine 10 may extract liquid from laundry items located within the treating chamber 34 during a cycle of operation by spinning the drum 32 about the longitudinal axis 48 such that centrifugal force extracts liquid from the laundry. Spin speeds are typically high in order to extract the maximum amount of liquid from the clothes in a short amount of time, thus saving time and energy. However, when laundry items and liquid are not evenly distributed about the longitudinal axis 48 of the drum 32 and/or evenly distributed about the circumference of the drum, an imbalance condition may occur. Typical spin speeds in a horizontal axis washer are 800-2000 RPM and provide a centrifugal force of 1 G or greater, sometimes even up to and greater than 400 G, to the laundry items. At such high speeds, an imbalance can result in unacceptable vibratory movement of the tub 28, the drum 32 and even the entire washing machine 10. The washing machine 10 can be affected severely enough that it may exhibit a side-to-side movement, when viewed from the front/rear, which results in a "walking" across the floor and cause floor vibration. The tub 28 can move enough such that the tub 28 reaches the limit of its suspension and/or contacts the surrounding chassis 12, referred to as "chassis hits," with consequent noise and possible damage. In addition, the imbalance can also cause the drum 32 to move relative to the tub 28 to such an extent that the drum 32 contacts the surrounding tub 28, with consequent noise and possible damage. The washing machine 10 can also exhibit undesirable movements when increasing the drum rotation speed through the suspension natural frequencies at drum speeds less than 400 rpm.

As used herein, spinning or rotating at a spin speed refers to rotating the drum 32 to apply a centrifugal force of greater than or equal to 1 G to at least some of the laundry items. Spin speeds are high rotation speeds that result in the laundry being held by centrifugal force against the inner surface of the drum 32 as the drum 32 rotates, also sometimes referred to as a satellizing or plastering condition. For a horizontal axis washing machine 10, the drum 32 may rotate about an axis that may be inclined relative to the horizontal, in which case the term "1 G" refers to the vertical component of the centrifugal force vector, and the total magnitude along the centrifugal force vector would therefore be greater than 1 G.

As a result of the suspended configuration of the tub 28 and the drum 32, the suspended mass comprising the tub 28 (including the counterweight 80), the drum 32, and the laundry items has six degrees of freedom: the suspended mass can translate along an x-axis (side-to-side movement), a y-axis (up-and-down movement), and a z-axis (front-to-back movement) and may rotate about the x-, y- and z-axes. When the motor 44 is mounted to the tub 28, the motor 44 may also form a part of the suspended mass. Alternatively, if the motor 44 is not mounted to the tub 28, but rather indirectly coupled to the tub 28, such as through a belt, the motor 44 and the belt may form a part of the suspended mass.

During rotation of the drum 32, as the speed of rotation increases, the suspended mass may pass through suspension natural frequencies corresponding to the six degrees of freedom. At these natural frequencies, the suspended mass has a natural tendency to move according to the corresponding degree of freedom, and this tendency may be increased dramatically when a load imbalance condition is present. Thus, when the suspended mass passes through x-axis and z-axis translational natural frequencies, the suspended mass with a load imbalance may swing side-to-side and front-to-back, much like a pendulum, and hit the sides of the chassis 12. Similarly, when the suspended mass passes through the y-axis translational natural frequency, the suspended mass with a load imbalance may have a tendency to move up-and-down and thereby hit the top of the chassis 12 and/or bottom out the suspension system 30 and may also hit the door 40. Finally, when the suspended mass passes through the rotational natural frequencies, the suspended mass with a load imbalance may have a tendency to rock within the chassis 12. In addition to the suspension natural frequencies, there are also structural natural frequencies that may occur that may cause the drum 32 to move relative to the tub 28 in a similar manner, causing the drum 32 to contact the tub 28. Typically tub to chassis hits occur when passing through the lower speed suspension natural frequencies and drum to tub hits occur at higher speeds when passing through the structural natural frequencies.

The suspension natural frequencies are a function of the size of the drum 32 and the amount of the suspended mass. The translational suspension natural frequencies occur at drum rotation speeds that have forcing functions that are large enough to generate large vibrations that may lead to movement of the washing machine 10. The drum rotation speeds corresponding to the translational natural frequencies are often referred to as the critical speeds of the appliance.

In order to minimize chassis hits, i.e. contact between the tub 28 and the chassis 12 during rotation of the drum 32, and tub hits, i.e. contact between the drum 32 and the tub 28, space is provided between the tub 28 and the chassis 12 and between the drum 32 and the tub 28. Still referring to FIG. 1, the washing machine 10 may be provided with front and rear chassis gaps 100, 102 between the front wall 14 of the chassis 12 and the front tub wall 84 and the rear wall 16 of the chassis 12 and rear tub wall 86, respectively. Upper and lower chassis gaps 104, 106 may also be provided between the tub side wall 82 and the chassis upper and bottom walls 22, 23, respectively. Side to side chassis gaps 107 (see FIG. 2) may also be provided between side walls 18 and 20 of the chassis 12 and the tub side wall 82. Front and rear tub gaps 108, 110 may be provided between the front tub wall 84 and the front drum wall 52 and the rear tub wall 86 and the rear drum wall 54, respectively. A side wall gap is provided between the tub side wall 82 and the drum side wall 55 along an axial length of the side walls 55, 82 and can vary radially and/or axially. The side wall gap can include upper and lower radial tub gaps 112, 114 between the drum side wall 55 and the tub side wall 82 that extend the axial length of the drum and tub side walls 55, 82. The upper tub gap 112 corresponds to the gap between an upper radial portion of the drum 32 and tub 28 along the axial length of the drum and tub side walls 55, 82 and the lower tub gap 114 corresponds to the gap between a lower radial portion of the drum 32 and tub 28 along the axial length of the drum and tub side walls 55, 82. The upper and lower tub gaps 112, 114 can be the same or different and can be consistent or vary along the axial length of the drum and tub side walls 55, 82. In one example, the upper and lower tub gaps 112, 114 are the same in a radial direction while staying consistent or varying along the axial length of the drum and tub side walls 55, 82.

The tub walls 82, 84, and 86 and the drum walls 52, 54, and 55 may not be uniform, planar structures, but may include additional structures or features that project therefrom or have varying cross-sectional dimensions. For example, the front tub wall 84 may include a tub collar 116 extending towards the chassis front wall 14 and the rear tub wall 86 may be provided with strengthening ribs that extend from the rear tub wall 86 towards the rear chassis wall 16. In another example, as may be seen in FIG. 3, the tub side wall 82 may vary in diameter along the longitudinal length 88. In another example, the counterweight 80 may project from the tub side wall 82 towards the walls 14, 16, 18, 20, 22, and 23. It will be understood that the chassis gaps 100, 102, 104, 106, 107 and the tub gaps 108, 110, 112, 114 take into consideration additional features that project from the tub walls 82, 84, and 86 and the drum walls 52, 54, and 55 to minimize chassis hits and tub hits. In addition, one or more portions of the chassis 12 or the cabinet 14, 16, 18, 20, 22, and 23 may include additional structures or features that project inward toward the tub 28 or have varying cross-sectional dimension that need to be taken into consideration to minimize chassis hits.

The dimensions of the chassis gaps 100, 102, 104, 106, 107 and the tub gaps 108, 110, 112, 114, effect the capacity efficiency of the washing machine 10. The larger the gaps, the lower the capacity efficiency. The number and location of the springs 70, the number and location of the dampers 72, and the amount and longitudinal location of the counterweight 80 may be configured such that the dimensions of the chassis gaps 100, 102, 104, 106, 107 and the tub gaps 108, 110, 112, 114 may be decreased, providing for an increase in the capacity efficiency of the washing machine 10.

Figure 6:
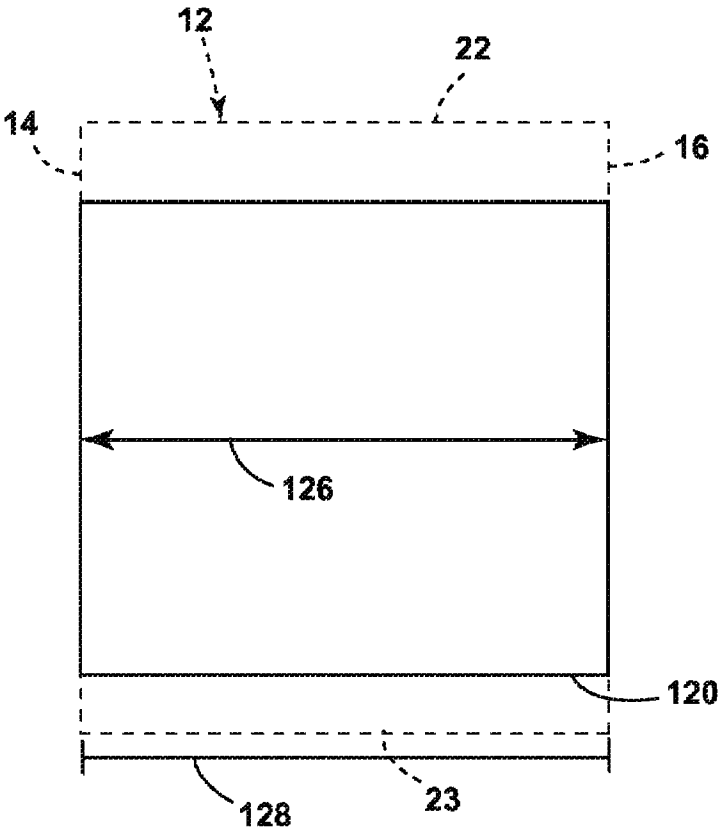
FIG. 6 is a side view of a laundry treating appliance illustrating an ideal cylinder for calculating capacity efficiency of a laundry treating appliance according to an embodiment of the invention.
Figure 5:
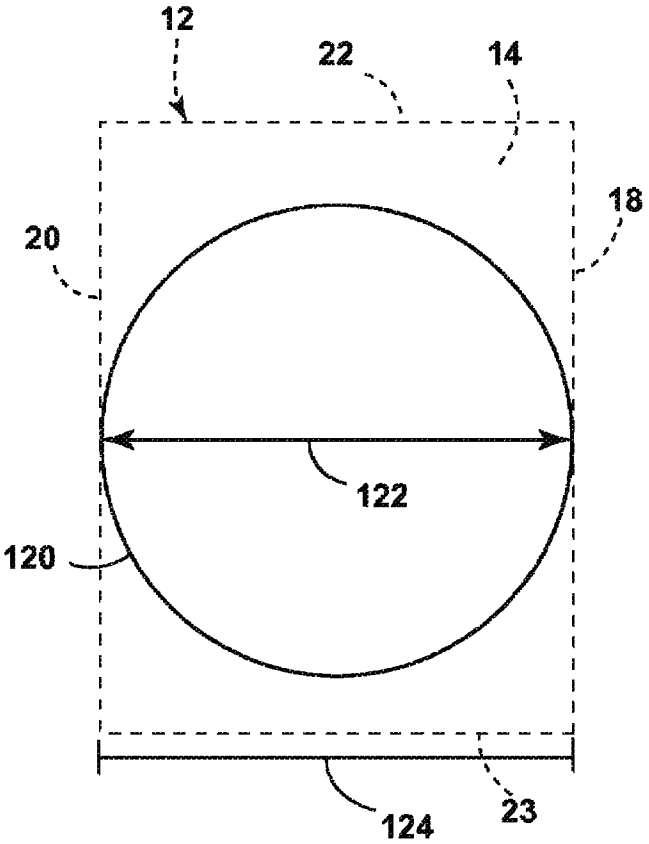
FIG. 5 is a front perspective view of a laundry treating appliance illustrating an ideal cylinder for calculating capacity efficiency of a laundry treating appliance according to an embodiment of the invention.

Referring now to FIGS. 5 and 6, capacity efficiency as used herein is expressed as a percentage and defined as an internal volume of the drum 32 divided by a volume of an ideal cylinder 120 based on the maximum dimensional confines of the washing machine 10 as defined by the chassis frame 13 and/or the walls 14, 16, 18, 20, 22, and 23. As illustrated in FIGS. 5 and 6, a diameter 122 of the ideal cylinder 120 is defined by a maximum width 124 of the washing machine 10 and a length 126 of the ideal cylinder 120 is defined by a maximum depth 128 of the washing machine 10. The internal volume of the drum 32 may be determined theoretically using measured dimensions of the drum 32 or empirically, such as based on a volume of water which completely fills the drum 32.

In a conventional two spring suspension system, the laundry holding system is supported by two springs near a center of the tub. The weight of the motor components cause a rear of the tub to tilt the tub to an angle relative to the surface supporting the washing machine. To counterbalance the weight of the motor components and adjust the tilt angle of the tub, a heavy counterbalance is added to the front of the tub to position the tub at the desired angle. As the weight of the counterweight increases, the displacement amplification factor between the drum and the tub at high spin speeds due to structural natural frequencies also increases while the structural natural frequencies decrease. The displacement amplification factor provides an estimate of the elastic response of a structure under the influence of the natural frequencies multiplied by a factor that provides an estimate of the response displacement. As the displacement amplification factor increases, the movement of the tub and drum at the natural frequencies also increases and a relative movement of the gaps between the tub and the drum also increases, providing a need for an increase in the gaps between the tub and drum in order to avoid contact between these structures as the rotation speed of the drum approaches the natural frequencies of the laundry holding system.

The embodiments of the present invention utilize the suspension system comprising at least 3 springs 70 and at least 3 dampers 72 to position the tub 28 at the desired angle within the chassis 12, rather than using a large counterweight mass. Exemplary angles for the tub 28 include 0 degrees (essentially horizontal) with respect to the surface supporting the washing machine or 15 degrees, for example. The location and amount of the counterweight 80 may then be selected to provide a desired increase in the natural frequencies of the laundry holding system independent of the angle of the tub 28. As the natural frequencies of the laundry holding system increase, the drum rotation speed corresponding to the natural frequencies moves farther away from the drum rotation speeds reached during the cycle of operation. This allows the tub gaps 108, 110, 112, 114 to be decreased based on a decrease in movement of the tub 28 and drum 32 at high drum rotation speeds. The mass of the counterweight 80 may also be selected to provide smaller displacements when progressing through the suspension natural frequencies of the laundry holding system, which allows the chassis gaps 100, 102, 104, 106, 107 to be decreased based on a decrease in laundry holding system displacements when passing through the suspension natural frequencies.

Referring again to FIG. 3, the tub 28 may include a counterweight 80 coupled to the upper and/or lower portions of the tub 28. The counterweights 80 may be coupled with the tub side wall 82 at a location between about 10% and 50% of the longitudinal length 88 of the tub 28. As used herein, the location as a percent of the longitudinal length 88 of the tub 28 is measured with respect to the front tub wall 84 corresponding to 0% of the longitudinal length 88 and the rear tub wall 86 corresponding to 100% of the longitudinal length 88. The location of the counterweights 80 may be selected within this range to provide the desired increase in structural natural frequencies of the system. The mass, number and location of the counterweights 80 may be selected to provide the desired displacement amplification factor, which, in combination with the increase in the natural frequencies of the system as a result of locating the counterweights 80 within the middle 10-50% of the longitudinal length 88, provides a laundry holding system with a decrease movement of the tub 28 and drum 32 at high drum rotation speeds. As discussed above, a decrease in the displacement amplification factor at high drum rotation speeds decreases the magnitude of movement of the components of the laundry holding system at high drum rotation speeds, allowing the dimensions of the tub to drum gaps 108, 110, 112, 114 that would normally be required to avoid contact between the tub 28 and drum 32 to be decreased.

In an exemplary embodiment, the dimensions of the chassis gaps 100, 102, 104, 106, 107 and the tub gaps 108, 110, 112, 114 may be selected to maintain the number of cabinet hits and tub hits below a predetermined threshold as the drum 32 is rotated at low and high speeds. The number and location of the springs 70, the dampers 72 and the amount and longitudinal location of the counterweights 80 may be selected to provide the desired displacement amplification factor and natural frequencies for the system such that the chassis and/or tub gaps may be decreased with a concomitant increase in the capacity efficiency of the laundry holding system while still maintaining the number of cabinet hits and tub hits below a predetermined threshold as the drum 32 is rotated at low and high speeds. In one example, the suspension system 30 and counterweights 80 may be selected such that the capacity efficiency of the laundry holding system is greater than 45% while the drum 32 may be rotated to impart a centrifugal force to the laundry up to and greater 400 G and/or to rotate the drum 32 at up to or greater than 1000 rpm without chassis or tub hits.

For example, a current state of the art washing machine may include a 17 mm tub gap between the tub side wall and the drum side wall to maintain the number of cabinet hits and tub hits below a predetermined threshold as the drum 32 is rotated at low and high speeds. A portion of this gap dimension is based on manufacturing tolerances and a portion of this gap dimension is based on operation tolerances determined so as to avoid drum and tub hits at high drum rotation speeds. In the conventional washing machine, the manufacturing and operation tolerances may be in the range of 5-10 mm for a tub side wall gap of 17 mm.

In the embodiments of the invention described herein, the suspension system 30 and counterweights 80 may be selected to provide the desired displacement amplification factor and natural frequencies for the system which allows for as much as a 30% or more decrease in the operation tolerance for the tub side wall gaps 112, 114 while still maintaining the number of cabinet hits and tub hits below a predetermined threshold as the drum 32 is rotated at high speeds. For example, the operation tolerance may be decreased such that the overall tub side wall gaps 112, 114 can be decreased from 17 mm to 12 mm, allowing for a larger drum and thus an increase in capacity efficiency of the laundry holding system. In one example, the suspension system 30 and counterweights 80 may be selected such that at least one of the tub gaps 112 and/or 114 is in the range of 12 mm or less along at least a portion of a length of the drum side wall 55 and the tub sidewall 82. In another example, the suspension system 30 and counterweights 80 may be selected such that at least one of the tub gaps 108 and/or 110 are within the range of 10 to 14 mm along at least a portion of a length of the front tub wall 84 and the front drum wall 52. In yet another example, the suspension system 30 and counterweights 80 may be selected such that at least one of the chassis gaps 100, 102, 104, 106, and/or 107 is less than 25 mm along at least a portion of the at least one cabinet wall 14, 16, 18, 20, 22, and 23. In still another example, the suspension system 30 and counterweights 80 may be selected such that a gap a gap between the tub collar 116 and the front wall 14 is less than 25 mm along at least a portion of a length of the front wall 14.

Table 1 illustrates capacity efficiency data for exemplary washing machines according to an embodiment of the invention and comparative data for conventional washing machines. The capacity efficiency is determined as described above with reference to FIGS. 5 and 6.

TABLE 1

Washing Machine Capacity Efficiency Comparison

| Washing Machine | Suspension System Springs/ Dampers | Cabinet width (inches) | Cabinet depth (inches) | Drum volume ($ft^3$) | Capacity Efficiency (%) |
|---|---|---|---|---|---|
| Example 1 | 4/4 | 27 | 32.8 | 5 | 46 |
| Example 2 | 4/4 | 27 | 35 | 5.46 | 47 |
| Example 3 | 4/4 | 29 | 33 | 5.7 | 45 |
| Example 4 | 4/4 | 29 | 33 | 6.1 | 48 |
| Example 5 | 4/4 | 29 | 35 | 6.3 | 47 |
| Example 6 | 4/4 | 29 | 35 | 6.6 | 49 |
| Comparative 1 | 2/4 | 27 | 32.8 | 4.33 | 40 |
| Comparative 2 | 2/3 | 27 | 29.8 | 4 | 41 |
| Comparative 3 | 2/3 | 27 | 29.8 | 4.26 | 43 |
| Comparative 4 | 2/3 | 29 | 32.3 | 5.16 | 42 |
| Comparative 5 | 2/4 | 27 | 34 | 4.47 | 40 |
| Comparative 6 | 2/4 | 30 | 32.5 | 5.6 | 42 |
| Comparative 7 | 2/4 | 27 | 31.5 | 4.42 | 42 |
| Comparative 8 | 2/4 | 28 | 34.4 | 4.8 | 39 |
| Comparative 9 | 2/4 | 27 | 34.375 | 4.3 | 38 |
| Comparative 10 | 2/4 | 27 | 30.3 | 3.9 | 39 |
| Comparative 11 | 2/3 | 29 | 33.875 | 5.2 | 40 |
| Comparative 12 | 2/3 | 23 | 24 | 2.26 | 38 |
| Comparative 13 | 2/3 | 23 | 24 | 2.26 | 38 |
| Comparative 14 | 2/3 | 23 | 26 | 2.79 | 43 |
| Comparative 16 | Fixed tub | 24 | 26 | 2.72 | 42 |
| Comparative 17 | 2/4 | 24 | 26 | 2.72 | 42 |
| Comparative 18 | 2/4 | 24 | 24 | 2.73 | 42 |
| Comparative 19 | 2/2 | 23 | 25 | 2.5 | 39 |

As illustrated by Examples 1-6, the embodiments of the invention may be used to increase the capacity efficiency of the washing machine 10 to 45% or greater, whereas the capacity efficiency for most conventional washing machines is typically within the range of 38-43%. The increase in capacity efficiency is desirable for consumers. The decrease in the operation clearances provided by the suspension system 30 and counterweights 80 described may provide for an increase in flexibility when designing the chassis 12, tub 28 and drum 32 and decrease the amount of unused space within the system.

In addition to effecting the dimensions of the chassis gaps 100, 102, 104, 106, 107 and the tub gaps 108, 110, 112, 114 and the position and size of the counterweight mass 80, the suspension system 30 comprising at least 3 springs 70 and at least 3 dampers 72 can also effect a change in the tilt angle of the laundry holding system based on the loading of the laundry holding system, referred to as sag, and a bending moment of the laundry holding system. The sag and bending moment of the laundry holding system can also effect the capacity efficiency of the laundry holding system based on their effect on the minimum dimensions of the chassis gaps 100, 102, 104, 106, 107 and the tub gaps 108, 110, 112, 114 selected to provide a desired outcome, such as maintaining the number of cabinet hits and tub hits below a predetermined threshold as the drum 32 is rotated at low and high speeds, as described above.

In a traditional 2 spring suspension system, it is generally desirable to couple the springs with the tub at a center of the longitudinal length of the tub. In this configuration, the laundry holding system will pivot about the point at which the springs are coupled with the tub. The laundry holding system is heavier in the rear than in the front due to the increased weight from the tub and drum back walls and the motor and thus the laundry holding system will tilt down in the rear and up in the front. Counterweights can be used to shift the center of gravity of the laundry holding system back towards the center to position the laundry holding system at the desired tilt angle.

However, when laundry is added and then water is supplied to the treating chamber to wet the laundry, the additional weight of the laundry and the supplied water can change the tilt angle of the laundry holding system compared to the empty laundry holding system. For systems in which the water is added to the tub and drum near the front of the system, the laundry holding system can tilt forward because the center of gravity of the laundry holding system has shifted in front of the center of the longitudinal length of the tub. Depending on the design of the system, the forward tilt of the laundry holding system can affect the accuracy of a fill level sensor provided in the tub for determining the amount of water supplied, which can affect the energy and cleaning efficiency of the cycle of operation. In addition, as the laundry holding system tilts forward, the likelihood that laundry will get caught in the bellows/door area of the laundry holding system increases. While adjusting the mass and location of the counterweight can provide the laundry holding system with a desired tilt angle, even when loaded, the counterweight can decrease the natural frequencies of the laundry holding system as well as affect the bending moment of the system.

The bending moment of the laundry holding system can also affect the minimum tub gaps 108, 110, 112, 114. The bending moment of the laundry holding system is based on the displacement amplification factor, an amount of a laundry imbalance, an amount of laundry, and the rotational speed of the drum. When the bending moment of the laundry holding system is above a predetermined threshold, undesirable chassis and/or tub hits may occur. Thus, traditionally, as the bending moment increases, the drum may need to be rotated at lower rotational speeds and/or rotated to redistribute the laundry more often than a laundry holding system having a lower bending moment. However, rotating at lower speeds and redistributing the load can undesirably increase the cycle time.

The suspension system 30 comprising at least 3 springs 70 and at least 3 dampers 72 described herein can be utilized to configure the laundry holding system to collectively optimize the dimensions of one or more of the chassis gaps 100, 102, 104, 106, 107, the tub gaps 108, 110, 112, 114, laundry holding system sag, and bending moment to increase the capacity efficiency of the laundry holding system.

A multi-body simulation model for an exemplary 4 spring suspension system and comparative 2 spring suspension systems was conducted using Automated Dynamic Analysis of Mechanical Systems (ADAMS) multibody dynamics software using models that were based on actual washing machine configuration. Optimization software was used to determine system inputs that minimized one or more of the chassis gaps 100, 102, 104, 106, 107 and/or tub gaps 108, 110, 112, 114 while satisfying constraints set on bending moment and sag of the laundry holding system.

Figure 7:
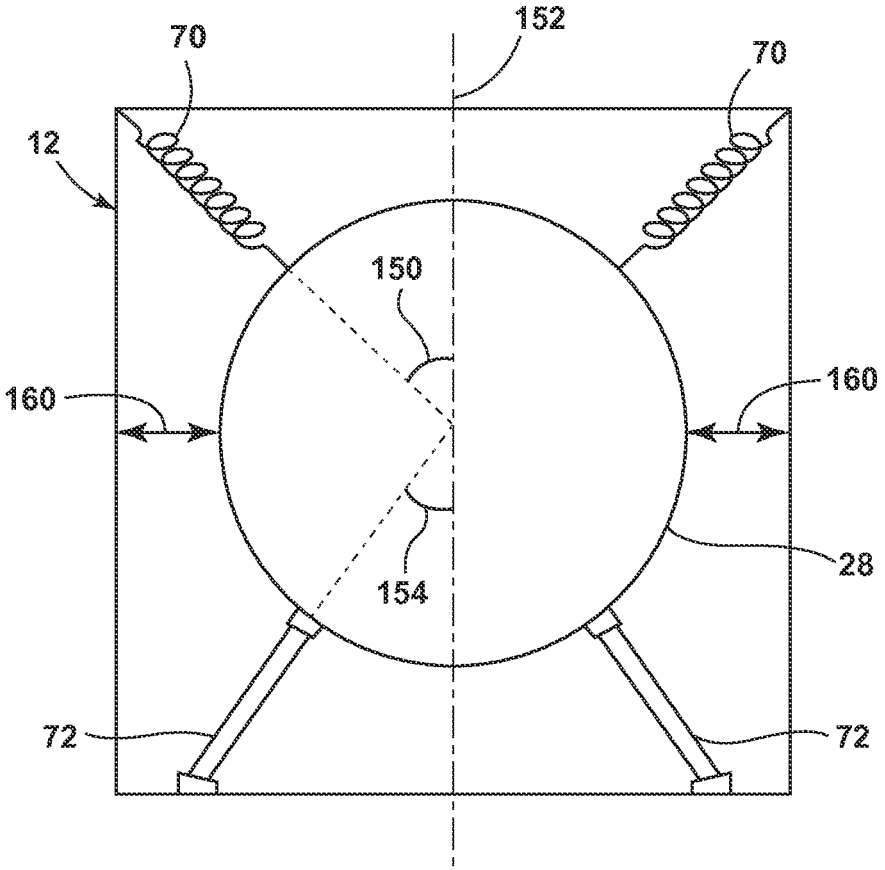
FIG. 7 is a schematic illustration of a laundry treating system illustrating measurement locations for a simulation model.

FIG. 7 illustrates the measurement locations for the input provided to the simulation model. All of the simulated models included 4 dampers and either 2 springs (comparative systems) or 4 springs (exemplary system). The springs 70 are vertical in the axial direction and are connected to the tub 28 in a radial direction at an angle 150 relative to a vertical axis 152 passing through a central axis of the tub 28. Similarly, the dampers 72 are vertical in the axial direction and are connected in a radial direction to the tub 28 at an angle 154 relative to the vertical axis 152. The axial position of the springs 70, dampers 72, and counterweight 80 were measured with respect to the front wall 84 of the tub 28 to a center of the point of connection between the spring 70 or damper 72 and the tub 28 or a center of mass of the counterweight 80.

The simulation model was repeated for each system tested with a 1.5 kg unbalance in either a front portion, center, or rear portion of the treating chamber 34 as the drum 32 is accelerated from 100 to 300 rpm. A 1.5 kg unbalance was selected for the simulation model because it is the maximum unbalance capacity for the exemplary system being tested. The outputs of the simulation model include optimized side-to-side tub displacement (mm), bending moment, and change in laundry holding system angle values. The side-to-side tub displacement represents the sum of the tub displacement in a lateral direction 160 at a front portion 90 and a rear portion 82 of the tub 28 during rotation of the drum from 80 to 350 rpm with respect to the static tub position when the unbalance is located in the front, center, and rear portion of the treating chamber 34. The change in laundry holding system angle is determined based on the difference in the tilt angle of the laundry holding system in a static, empty condition and a static, maximum load condition. A negative change in laundry holding system angle indicates that the front of the laundry holding system tilted downward with respect to horizontal while a positive change in laundry holding system angle indicates the front of the laundry holding system tilted upward with respect to horizontal. The maximum load for each system was determined based on the drum volume according to Table 5.1 "Test Load Sizes" set forth in the Department of Energy's "Energy Conservation Program: Test Procedures for Residential Clothes Washers," 10 CFR Part 429, Docket No. EERE-2013-BT-TB-0009, RIN: 1904-AC97.

Tables 2 and 3 illustrate the inputs for the multi-body simulation model for 4 Spring Exemplary Systems A-B and 2 Spring Comparative Systems A-D. Table 4 illustrates the corresponding outputs for the multi-body simulation model for 4 Spring Exemplary Systems A-B and 2 Spring Comparative Systems A-D based on the inputs from Tables 2 and 3.

TABLE 2

Simulation Model Damper & Spring Inputs

| | Dampers (fixed at 4) | | Springs | | | | |
|---|---|---|---|---|---|---|---|
| Examples | Angle Front/Rear | Axial position[1] Front/Rear | No. | Angle | Length[2] | Spring constant[3] | Axial position[1] |
| 2 Spring Comparative System A | 0.05525/5.5632 | 0.0471/0.523 | 2 | 5.04 | 0.1225 | 5607.8 | 0.0399/0.438 |
| 2 Spring Comparative System B | 0.0039/5.04345 | 0.05422/0.523 | 2 | 5.60 | 0.116 | 3341.6 | 0.0399/0.437 |
| 2 Spring Comparative System C | 0.0208/6.12805 | 0.04717/0.52369 | 2 | 21.58 | 0.1755 | 3991.04 | 0.0399/0.437 |
| 2 Spring Comparative System D | 0.0208/6.12805 | 0.04717/0.52369 | 2 | 21.58 | 0.1755 | 3991.04 | 0.0399/0.437 |
| 4 Spring Comparative System A | 0.0273/5.0022 | 0.0471/0.57486 | 4 | 5.0066/5.0242 (Front/Rear) | 0.127/0.117 (Front/Rear) | 3493.4/7000 (Front/Rear) | 0.0399/0.437 |
| 4 Spring Comparative System B | 0.0052/5.08085 | 0.0471/0.57486 | 4 | 5.01595/5.00055 (Front/Rear) | 0.127/0.117 (Front/Rear) | 3577.72/6999.195 (Front/Rear) | 0.0399/0.437 |

[1]Measured in meters from the front of the bellows.
[2]Measured in meters.
[3]Measured in Newtons/meter.

TABLE 3

Simulation Model Counterweight Inputs

| | Counterweight | |
|---|---|---|
| Examples | Weight (kg) | Axial position (mm)[4]/% of tub length[5] |
| 2 Spring Comparative System A | 10.57 | 7.9% |
| 2 Spring Comparative System B | 10.53 | 7.7% |
| 2 Spring Comparative System C | 10.52 | 30% |
| 2 Spring Comparative System D | 10.52 | 30% |
| 4 Spring Comparative System A | 10.52 | 7.7% |
| 4 Spring Comparative System B | 10.53 | 7.7% |

[4]Measured in millimeters from the tub front wall.
[5]Measured with respect to the tub front wall corresponding to 0% of the tub length and the rear tub wall corresponding to 100%.

TABLE 4

Simulation Model Outputs

| Examples | Side-to-Side Displacement Front/Rear | Bending Moment | Change in Laundry Holding System Angle[6] | Capacity Efficiency |
|---|---|---|---|---|
| 2 Spring Comparative System A | 66.09/55.85 | 398.88 | −1.44 | 46.8% |
| 2 Spring Comparative System B | 67.60/62.10 | 400.18 | −1.44 | 46.5% |
| 2 Spring Comparative System C | 75.53/63.98 | 297.31 | −1.26 | 42.2% |
| 2 Spring Comparative System D | 75.53/63.98 | 297.31 | −1.26 | 42.2% |
| 4 Spring Comparative System A | 64.68/54.11 | 399.98 | 0.12 | 46% |
| 4 Spring Comparative System B | 64.80/53.97 | 399.96 | 0.10 | 44.3% |

[6]A negative value indicates that the front of the laundry holding system tilted downward with respect to horizontal while a positive value indicates the front of the laundry holding system tilted upward with respect to horizontal.

As can be seen in the outputs in Table 4, 2 Spring Comparative Systems A and B demonstrate acceptable side-to-side tub displacement, as compared to the 4 Spring Exemplary Systems A-B, but an undesirable reduction in the laundry holding system tilt angle of greater than 1.4 degrees. In general, a 1 degree or less reduction in the angle of the laundry holding system is considered an acceptable change that mitigates the challenges discussed above that can occur when the tilt angle of the laundry holding system is too great, such as inaccurate sensor detection of the water fill level and laundry getting caught in the bellows/door area.

2 Spring Comparative Systems C and D include a counterweight that is positioned farther back from the front tub wall 84 than the 2 Spring Comparative Systems A and B and the 4 Spring Comparative Systems A and B. While the 2 Spring Comparative Systems C and D demonstrate a marginally better change in laundry holding system angle compared to the 2 Spring Comparative Systems A and B, the side-to-side tub displacement is higher than the 4 Spring Exemplary System A and B, which results in a reduced capacity efficiency.

Still referring to Table 4, the 4 Spring Exemplary Systems A and B exhibit comparable or better side-to-side tub displacement and comparable bending moment with respect to the 2 Spring Comparative Systems A-D and also exhibit a reduction in laundry holding system angle that is less than 1. A change in angle of less than 1 decreases the likelihood that laundry will get caught in the bellows/door area of the laundry holding system and thus the door does not have to project as far into the treating chamber, which can increase the capacity of the drum. To the extent not already described, the different features and structures of the various embodiments of the invention may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating laundry according to an automatic cycle of operation, the laundry treating appliance comprising:

a chassis defining an interior;

a laundry holding system defined by at least a tub provided within the interior and a drum provided within the tub and configured for rotation about a longitudinal axis;

a drive system comprising a motor mounted to the tub and having a drive shaft drivingly coupled to the drum to selectively rotate the drum about the longitudinal axis;

a suspension system coupling the laundry holding system with the chassis, the suspension system comprising at least three springs coupling an upper portion of the tub to the chassis and at least three dampers coupling a lower portion of the tub to the chassis; and at least one counterweight provided on the tub at a location between about 10-50% of a longitudinal length of the tub and configured to provide a desired change in the natural frequency of the laundry holding system;

wherein the at least three springs and the at least three dampers are configured to adjust an angle of the tub to compensate for a tilt of the tub induced by a weight of the drive system, independent of the mass of the at least one counterweight; and wherein the number of springs, the number of dampers, and a longitudinal location of the at least one counterweight are configured such that a capacity efficiency of the laundry treating appliance is greater than 45%.

2. The laundry treating appliance of claim 1 wherein the motor can rotate the drum to impart a centrifugal force to laundry within the drum up to 400 G without the tub hitting the chassis and without the drum hitting the tub.

3. The laundry treating appliance of claim 2 wherein the motor can drive the drum to rotate the drum at 1000 rpm without the tub hitting the chassis and without the drum hitting the tub.

4. The laundry treating appliance of claim 1 wherein the suspension system comprises three springs and three dampers and wherein at least one of the springs and at least one of the dampers is coupled with the tub at a front third of the longitudinal length of the tub and at least one of the springs and at least one of the dampers is coupled with the tub at a rear third of the longitudinal length of the tub.

5. The laundry treating appliance of claim 4 further comprising a second spring and a second damper coupled with the tub at either the front third of the longitudinal length of the tub or the rear third of the longitudinal length of the tub.

6. The laundry treating appliance of claim 1 wherein the suspension system comprises four springs and four dampers and wherein two of the springs and two of the dampers are coupled with the tub at a front third of the longitudinal length of the tub and two of the springs and two of the dampers are coupled with the tub at a rear third of the longitudinal length of the tub.

7. The laundry treating appliance of claim 1 wherein a gap between a side wall of the drum and a side wall of the tub is in the range of 12 mm or less along at least a portion of a length of the drum side wall and the tub side wall.

8. The laundry treating appliance of claim 1 wherein the tub comprises a tub front wall and the drum comprises a drum front wall and wherein a gap between the tub front wall and the drum front wall is in the range of 10 to 14 mm along at least a portion of a length of the tub front wall and the drum front wall.

9. The laundry treating appliance of claim 1 wherein a gap between the tub and at least one wall of the chassis is less than 25 mm along at least a portion of a length of the at least one wall of the chassis.

10. The laundry treating appliance of claim 1 wherein a gap between a collar of the tub and at least one wall of the chassis is less than 25 mm.

11. The laundry treating appliance of claim 1 wherein the capacity efficiency of the laundry treating appliance is greater than 48%.

12. The laundry treating appliance of claim 1 wherein the tub and the drum define a laundry holding unit and wherein a reduction in angle of the laundry holding unit for a maximum load condition is equal to or less than 1 degree from the angle for an unloaded condition.

13. A method of assembling a laundry treating appliance for treating laundry according to an automatic cycle of operation, the method comprising:

providing a chassis having an interior;

providing a laundry holding system defined by at least a tub within the interior and a drum within the tub, the drum configured for rotation about a longitudinal axis;

mounting a motor to the tub, the motor drivingly coupled to the drum through a drive shaft to selectively rotate the drum about the longitudinal axis, the motor and the drive shaft forming a drive system;

coupling the laundry holding system with the chassis through a suspension system, the suspension system comprising at least three springs coupling an upper portion of the tub to the chassis and at least three dampers coupling a lower portion of the tub to the chassis; and providing at least one counterweight on the tub at a location between about 10% and 50% of a longitudinal length of the tub to provide a desired change in the natural frequency of the laundry holding system;

wherein the at least three springs and the at least three dampers are configured to adjust an angle of the tub to compensate for a tilt of the tub induced by a weight of the drive system, independent of the mas of the at least one counterweight; and wherein the number of springs, the number of dampers, and a longitudinal location of the counterweight are configured such that a capacity efficiency of the laundry treating appliance is greater than 45%.

14. The method of claim 13 wherein the motor is configured to rotate the drum to impart a centrifugal force to laundry within the drum up to 400 G without the tub hitting the chassis and without the drum hitting the tub.

15. The method of claim 14 wherein the motor can drive the drum to rotate the drum at 1000 rpm without the tub hitting the chassis and without the drum hitting the tub.

16. The method of claim 13 wherein the suspension system comprise three springs and three dampers, the method further comprising coupling at least one of the springs and at least one of the dampers with the tub at a front third of the longitudinal length of the tub and coupling at least one of the springs and at least one of the dampers with the tub at a rear third of the longitudinal length of the tub.

17. The method of claim 16 further comprising coupling a second spring and a second damper with the tub at either the front third of the longitudinal length of the tub or the rear third of the longitudinal length of the tub.

18. The method of claim 13 wherein the suspension system comprises four springs and four dampers, the method further comprising coupling two of the springs and two of the dampers with the tub at a front third of the longitudinal length of the tub and coupling two of the springs and two of the dampers with the tub at a rear third of the longitudinal length of the tub.

19. The method of claim 13, further comprising providing the drum within the tub such that a gap between a side wall of the drum and a side wall of the tub is in the range of 12 mm or less along at least a portion of a length of the drum side wall and the tub side wall.

20. The method of claim 13 wherein the tub comprises a tub front wall and the drum comprises a drum front wall, the method further comprising providing drum within the tub such that a gap between the tub front wall and the drum front wall is in the range of 10 to 14 mm along at least a portion of a length of the tub front wall and the drum front wall.

21. The method of claim 13, further comprising providing the tub within the chassis such that a gap between the tub and at least one wall of the chassis is less than 25 mm along at least portion of a length of the at least one wall of the chassis.

22. The method of claim 13 wherein the tub comprises a collar, the method further comprising providing the tub within the chassis such that a gap between the collar of the tub and at least one wall of the chassis is less than 25 mm.

23. The method of claim 13 wherein the capacity efficiency of the laundry treating appliance is greater than 48%.

24. The method of claim 13 wherein the tub and the drum define a laundry holding unit, the method further comprising configuring the number of springs, the number of dampers, and the longitudinal location of the counterweight such that a change in an angle of the laundry holding unit in an unloaded condition and a maximum load condition is equal to or less than 2 degrees.

* * * * *